US009340263B2

(12) United States Patent
Koppert

(10) Patent No.: US 9,340,263 B2
(45) Date of Patent: May 17, 2016

(54) MOTION COMPENSATION DEVICE FOR COMPENSATING A CARRIER FRAME ON A VESSEL FOR WATER MOTION

(75) Inventor: Pieter Martijn Koppert, 's-Gravenzande (NL)

(73) Assignee: BARGE MASTER IP B.V., Schiedam (NL)

( * ) Notice: Subject to any disclaimer, the term of this patent is extended or adjusted under 35 U.S.C. 154(b) by 476 days.

(21) Appl. No.: 13/262,757

(22) PCT Filed: Apr. 3, 2009

(86) PCT No.: PCT/NL2009/000082
§ 371 (c)(1),
(2), (4) Date: Oct. 3, 2011

(87) PCT Pub. No.: WO2010/114359
PCT Pub. Date: Oct. 7, 2010

(65) Prior Publication Data

US 2012/0024214 A1 Feb. 2, 2012

(51) Int. Cl.
*B63B 27/10* (2006.01)
*B66C 13/02* (2006.01)

(52) U.S. Cl.
CPC ..... *B63B 27/10* (2013.01); *B66C 13/02* (2013.01)

(58) Field of Classification Search
CPC ..... B63B 17/0081; B63B 29/12
USPC ..... 244/110 E; 108/4; 114/191, 192, 122; 248/550
See application file for complete search history.

(56) References Cited

U.S. PATENT DOCUMENTS

| | | | | |
|---|---|---|---|---|
| 4,564,356 | A * | 1/1986 | Winfree | 434/29 |
| 4,930,435 | A * | 6/1990 | Newman | 114/191 |
| 5,590,618 | A * | 1/1997 | Marshall | 114/343 |
| 5,947,740 | A | 9/1999 | Kim | |
| 6,059,253 | A * | 5/2000 | Koutsky et al. | 248/550 |

(Continued)

FOREIGN PATENT DOCUMENTS

| | | |
|---|---|---|
| GB | 2163402 A | 2/1986 |
| NL | 1027103 | 3/2006 |
| WO | 2007120039 A1 | 10/2007 |

OTHER PUBLICATIONS

English Abstract for NL 1027103.

(Continued)

*Primary Examiner* — Edwin Swinehart
(74) *Attorney, Agent, or Firm* — Hoffmann & Baron, LLP

(57) ABSTRACT

A carrier frame on a vessel for local water motion includes a carrier frame (2); an actuator system (4, 5, 6) adapted for translating the carrier frame (2) along a z-axis and rotating the carrier frame around an x-axis and an y-axis; a sensor system (8) for sensing z-axis translational movement and x-axis and y-axis rotational movements of the vessel; and a control system (9) generating control signals for driving the actuator system in response to the sensor signals. The actuator system includes at least three cylinder-piston-units each having a longitudinal axis (14), which longitudinal axes are mutually parallel in a rest position. Each cylinder-piston unit has an upper support (15) for supporting the carrier frame on said cylinder-piston-unit and a lower support (16) for supporting the cylinder-piston-unit on a base. The upper support and/or lower support allows for rotational movement. A resilient system generates resilient reaction forces upon disturbance of said rest position, which reaction forces counteract the disturbance of the rest position.

34 Claims, 6 Drawing Sheets

(56) References Cited

U.S. PATENT DOCUMENTS

| | | | | |
|---|---|---|---|---|
| 6,182,596 | B1 * | 2/2001 | Johnson | 114/284 |
| 7,152,547 | B1 | 12/2006 | Hovland | |
| 2008/0041296 | A1 * | 2/2008 | Thompson et al. | 114/364 |

OTHER PUBLICATIONS

Stewart, D., "A Platform With Six Degrees of Freedom", Proc Instn Mech Engrs, vol. 190, Pt 1, No. 15, pp. 371-386 (1965-66).

* cited by examiner

MOTION COMPENSATION DEVICE FOR COMPENSATING A CARRIER FRAME ON A VESSEL FOR WATER MOTION

CROSS-REFERENCE TO RELATED APPLICATIONS

This application is the National Stage of International Application No. PCT/NL2009/000082, filed Apr. 3, 2009, the contents of which is incorporated by reference herein.

FIELD OF THE INVENTION

The present invention relates in general to a motion compensation device for compensating a carrier frame—which might for example carry a load transfer device, like a crane or gantry—on a vessel for local water motion.

More specifically, the present invention relates to a motion compensation device for compensating a carrier frame, on a vessel for local water motion wherein the device comprises:

a carrier frame for carrying the crane;

an actuator system adapted for translating the carrier frame along a z-axis and rotating the carrier frame around an x-axis and an y-axis, wherein the x-axis, y-axis and z-axis define an imaginary set of orthogonal axes, the z-axis extending vertical;

a sensor system for sensing z-axis translational movement, x-axis rotational movement and y-axis rotational movement of the vessel and generating sensor signals representing said sensed movements of the vessel;

a control system generating control signals for driving the actuator system in response to said sensor signals such that the position of the carrier frame is compensated for said sensed movements of the vessel.

The invention further relates to an assembly comprising such a motion compensation device according to the invention and a crane, which assembly might further comprise a vessel as well.

The invention further relates to an assembly comprising such a motion compensation device according to the invention and a vessel, which assembly preferably comprises a crane as well. Worded differently, the present invention thus also relates to a vessel provided with a motion compensation device according to the invention, which vessel preferably is provided with a crane as well.

BACKGROUND OF THE INVENTION

When transferring loads from a vessel to another vessel or to some other construction, which might be movable or unmovable relative to the ground, problems arise due to movement of the water on which the vessel floats. Motion of the water subjects the load transfer device, and consequently the load to be transferred, to similar movements. In case the load is carried by a hoisting cable, the water motion will cause a swinging movement of the load as well. Similar problems arise when a vessel is receiving a load, like a helicopter landing on the vessel, a container or other load. Movement of the water causes the vessel to move, which in turn causes similar movement of the location on the vessel which is to receive the load.

Also when the weather conditions are very calm, the above mentioned problems due to local water movement are present. In this respect it is to be noted that although evidently the water is brought into motion strongly by wind, the effects of wind can lag for weeks in water and have influence on water at large distance away from the location of the wind.

Even the water might look like very calm, but still being in motion due to wind weeks ago and/or far away. The effect of this on for example marine building operations is that one has to wait for the water to be almost motionless, in case for example a crane with hoisting cable is to be used safely.

With respect to the motions to which a vessel on water is subjected, it is to be noted that a vessel is in fact subject to 6 degrees of freedom of movement, three translational movements and three rotational movements. Using a mathematical approach based on a carthesian coordinate system having an imaginary set of three orthogonal axes—an x-axis, y-axis and z-axis—these 6 movements can be called x-axis translational movement, y-axis translational movement, z-axis translational movement, x-axis rotational movement, y-axis rotational movement and z-axis rotational movement. It is to be noted, that from a mathematical point of view there are also other equivalent manners to define the 6-degrees of movement in a space, for example the 3 axes used might not be orthogonal with respect to each other or a so called spherical coordinate system might be used. It is just a matter of mathematical calculation to transfer one definition of 6 degrees of freedom of movement into another definition of 6 degrees of freedom of movement. Using the so called carthesian coordinate system and defining the z-axis as extending vertically, the x-axis as extending in longitudinal direction of a vessel and the y-axis as extending in transverse direction of a vessel, the x-axis translational movement is in practise called surge
the y-axis translational movement is in practise called sway
the z-axis translational movement is in practise called heave
the x-axis rotational movement is in practise called roll
the y-axis rotational movement is in practise called pitch
the z-axis rotational movement is in practise called yaw GB 2.163.402 discloses an arrangement for open sea transfer of articles between two vessels, which arrangement uses a gantry—having two hingingly connected arms—mounted with one end of the gantry upon a vessel and carrying on the other free end of the gantry a carrying device in the form of a load platform. The load carrying device is space stabilised, it carries a stabilisation sensing arrangement which senses all three rotational and all three translational movements of the load carrying device in space and provides signals so that the gantry can be controlled by jacks and associated control means for compensation of all three rotational movements and all three rotational movements. This arrangement is complex in construction and unable to compensate for local water movements in case the load is carried by a hoisting cable. Also the control for compensation of 6 degrees of freedom of movement is complex. Further, taking into account that the load platform provided with the sensors is due to being carried by a hinging arm (the gantry) at a large distance from the vessel, the rotational movements of the vessel are first increased in magnitude by the arm length and afterwards compensated, which makes the control more difficult.

U.S. Pat. No. 5,947,740 discloses a simulator enabling an operator to reproduce or represent under test conditions phenomena likely to occur. This simulator comprises a platform carried by six+one hydraulic units. The lower ends of the six hydraulic units are fixed in pairs of two in a triangular pattern to the fixed world and the upper ends are fixed in different pairs of two to a simulation platform, also in a triangular pattern. In rest position all the six hydraulic units extend obliquely with respect to the vertical—none of the hydraulic units being parallel to each other in the rest position. These six hydraulic units are actively controlled to move the platform for simulation purposes. The other one hydraulic unit is a vertical one, which essentially carries the load of the platform and is passive, i.e. not controlled. Advantage of this passive central hydraulic unit is that the other six hydraulic units are just for control of movements of the platform and do not need to support the load of the platform. The forces to be exerted for control of the movement of this platform are thus reduced. Although the document does not appear to say so, this simulator is of the type which is used for flight simulators for training airplane pilots. It is known, that this simulator of U.S. Pat. No. 5,947,740 is also used to compensate a passenger transfer platform on a vessel against movement of the water, so that the passengers can walk easily to another vessel or a construction with fixed position without movement of the gangway. The difference between simulator and movement compensator application being essentially in the control. In the compensator application, the control is based on measurements of movement sensors to compensate the six degrees of freedom of movement of the platform for the measured movement. This compensator and its control system are relatively complex and consequently also expensive.

SUMMARY OF THE INVENTION

The present invention has as its object to provide motion compensation device for compensating a carrier frame on a vessel for local water motion, which is relatively simple in construction and control.

According to the invention this object is achieved by providing a motion compensation device for compensating a carrier frame on a vessel for local water motion, wherein the device comprises:

- a said carrier frame;
- an actuator system adapted for translating the carrier frame along a z-axis and rotating the carrier frame around a x-axis and a y-axis, wherein the x-axis, y-axis and z-axis define an imaginary set of orthogonal axes, the z-axis extending vertical;
- a sensor system for sensing z-axis translational movement, x-axis rotational movement and y-axis rotational movement of the vessel and generating sensor signals representing said sensed movements of the vessel;
- a control system generating control signals for driving the actuator system in response to said sensor signals such that the position of the carrier frame is compensated for said sensed movements of the vessel;

characterized, in that the actuator system comprises at least three cylinder-piston-units each having a vertical longitudinal axis;

in that each cylinder-piston unit has an upper support for supporting the carrier frame on said cylinder-piston-unit and a lower support for supporting said cylinder-piston-unit on a base; in that

- the upper support allows for rotational movement of the respective cylinder-piston-unit relative to the carrier frame around the x-axis as well as the y-axis;
- and/or
- the lower support allows for rotational movement of the respective cylinder-piston-unit relative to the base around the x-axis as well as the y-axis;

and in that the device further comprises a mechanical constraining system restricting x-axis translational movement, y-axis translational movement and z-axis rotational movement of the carrier frame with respect to the base.

According to the invention the actuator system comprises at least three cylinder-piston-units, preferably hydraulic cylinder-piston-units, which are arranged essentially parallel, especially essentially vertical (i.e. in the z-axis direction). In use these cylinder-piston units can be extend or shortened simultaneously to adjust the vertical height—in z-axis direction—of the carrier frame with respect to the vessel. During use, when a vessel is essentially stationary on its place this is the dominant vessel movement to be compensated for when the vessel goes up and down with the—often relatively slow and long—wave movement of the water. The less dominant sideways roll of the vessel and aft-front pitch of the vessel are compensated for by adjusting the cylinder-piston-units differently with respect to each other. Although it is possible that the cylinder-piston-units are fixed with respect to each other in the sense that during use their relative positions remain unchanged—for example in case they are mutually perfect parallel they will always extend mutually parallel—, it is in practise more practical to allow them some freedom of rotational movement around the x-axis or y-axis, i.e. during use the longitudinal axis of said cylinder-piston-units undergo some movement relative to each other. Here a vertical longitudinal axis—of a said cylinder-piston-unit—is understood to comprise deviations of the longitudinal axis with respect to the vertical of less than 15°, preferably at most 10°, more preferably at most 5°. In rest position—defined as a position in which the carrier frame and base are parallel to each other—, the said piston-cylinder-units will however preferably be mutually parallel. In order to prevent jamming of the device due to the device being over-determined, the upper and/or lower support of each cylinder-piston-unit is/are arranged to allow for x-axis rotational movement and y-axis rotational movement. The constraining system restricts x-axis translational movement, y-axis translational movement and z-axis rotational movement of the carrier frame with respect to the base to movements necessary to allow for z-axis translational movement, x-axis rotational movement and y-axis rotational movement of the carrier frame with respect to the base by said actuator system. Advantages of the device according to the invention are that the control for compensational movements is less complicated—the piston-cylinder-units will essentially stay parallel which simplifies the control—; that three piston-cylinder-units are sufficient, although easily more, in rest position, essentially parallel piston-cylinder-units can be used as well, in case this might be practical for whatever reason, without the control becoming much more complicated; and that relatively little space is needed in order to allow compensational movements of the support frame because the piston-cylinder-units stay essentially parallel during use (with a system like in U.S. Pat. No. 5,947,740 all space below the platform is required to be free from obstacles in order to allow the piston-cylinder-units to move between different slanting positions).

The concept behind this invention is that in most cases, it suffices to compensate only for z-axis translational movement, x-axis rotational movement and y-axis rotational movement of the vessel. The other three degrees of freedom of movement of the vessel (i.e. the z-axis rotational movement, the x-axis translational movement and the y-axis translational movement) need not be compensated for because they are under many circumstances negligible. These other three degrees of freedom of movements being negligible can have different reasons. When the carrier frame is, for example, a landing platform for a helicopter or a receiving platform for a load, these other degrees of freedom of movement might not play a role at all. When, for example, the vessel is anchored and/or kept in position by a dynamic positioning control, these other degrees of freedom of movement are already being taken care of.

In order to assist the carrier platform in reassuming its rest position, it is advantageous when the constraining system is resilient, i.e. comprises some resilient properties. In order to prevent oscillation due to the set back forces exerted by the resilient constraining system, it is according to the invention advantageous when the resilient constraining system is a damped resilient constraining system.

In order to arrange the upper and/or lower support of each cylinder-piston-unit to allow for x-axis rotational movement and y-axis rotational movement, it is according to the invention advantageous when the upper respectively lower support comprises one of the group of: cardan joint, spherical bearing or ball hinge. A cardan joint has two mutually transverse hinges, both transverse to the longitudinal axis of the joint, which hinges provide for the freedom for x-axis and y-axis rotational movement. This freedom for x-axis and y-axis rotational movement can also be achieved with a ball hinge or a spherical bearing. In general, the degree of freedom achievable with a spherical bearing is less than with a ball hinge. But, taking into account that the required degree of freedom is in many applications relatively small, a spherical bearing is in many applications satisfactory.

According to a further embodiment, the constraining system comprises:

at least one column fixed to said base and extending in the direction of the z-axis; and for each column at least three guiding wheels which are swivelling suspended to the carrier frame to swivel around a swivel axis perpendicular to the z-axis, said at least three guiding wheels being arranged distributed around said column for riding along the length of said column, wherein a spring pretensions each guiding wheel to be swiveled against said column.

The column serves as guide to guide movement of the carrier frame in z-axis direction. When the carrier frame moves in z-axis direction, the guiding wheels will ride along the column. In order to allow the carrier frame to move with respect to the column in a direction transverse to the z-axis, the guiding wheels are suspended to the carrier frame in swivelling manner. The springs provide for a set back force which tends to restore the rest position. Although one said column could suffice, it is, with this embodiment, for smooth guidance advantageous to have a said column for each cylinder-piston-unit. In order to protect the cylinder-piston-units against damage from the surrounding, it is, with this embodiment, according to the invention advantageous when each said cylinder-piston-unit extends through said column. In order to obtain good guidance on the one hand and good set back towards the rest position on the other hand, it is, with this embodiment, according to the invention advantageous when four said guiding wheels are arranged around each said column, which guiding wheels are interspaced at 90° around the column. For damping action, it is according to the invention advantageous when the springs are provided with a damper for damping the spring action.

According to another embodiment, it is according to the invention advantageous when the constraining system comprises at least three bars, each bar being attached to the base with one end and to the carrier frame with the other end. These bars function in their longitudinal direction as essentially rigid push-pull-elements. The ends of these bars might be hingedly attached to the carrier frame and base, for example by means of a cardan joint. In case the attachment of the ends of the bars is constrained against z-axis rotation, the ends of a bar are movable with respect to each other by deflection.

For load spreading purposes and easy installing the device according to the invention on a vessel, it is according to the invention advantageous when the base comprises a separate base segment for each cylinder-piston-unit. A separate base segment for each cylinder-piston-unit provides sufficient spread of load as well as it allows easy and wobble-free placement of the device on a non-even deck or other surface of the vessel.

For easy transportation of the device according to the invention, such as transportation over sea, road or rail, it is advantageous when each separate base segment has outer dimensions corresponding to the outer dimensions of a standard sea container, preferably a 20, 30 or 40 feet container.

For easy transportation of the device according to the invention, it is further advantageous when each cylinder-piston-unit is hingedly mounted to either the carrier frame or the base for storing the cylinder-piston-unit with its longitudinal direction extending transverse, preferably perpendicular, to the z-axis. This allows a compact storage position.

According to the invention, it is further advantageous when:

- each cylinder-piston-unit has a maximum stroke in the range of 1 to 3.5 meter, preferably in the range of 1 to 2 meter; and/or
- viewed transverse to the z-axis, the largest distance between two said cylinder-piston-units of said at least three cylinder-piston units is at most 40 meters, preferably at most 30 meters.

A device with this maximum stroke for the cylinder-piston-units and/or this largest distance between two said cylinder-piston-units, is on the one hand relatively compact and on the other hand suitable for use in most near shore applications and/or applications under calm weather conditions.

According to a further aspect, the invention relates to an assembly comprising: a device according to the invention; and a crane. The crane can comprise a hoisting cable or a gripper which is hinged to a crane arm. It is further advantageous when this assembly comprises a vessel.

According to another further aspect, the invention relates to an assembly comprising: a device according to the invention; and a vessel.

According to the invention, it is further advantageous when the vessel is provided with an anchoring system arranged for preventing the vessel from x-axis translational movement, y-axis translational movement and z-axis rotational movement; and/or when the vessel is provided with a dynamic positioning system arranged for preventing the vessel from x-axis translational movement, y-axis translational movement and z-axis rotational movement.

According to still another aspect, the invention relates to a method for compensating a carrier frame on a vessel for local water motion, wherein the carrier frame is supported by an actuator system comprising at least three cylinder-piston-units, each having a vertical longitudinal axis; wherein z-axis translational movement, x-axis rotational movement and y-axis rotational movement of the vessel are measured; and wherein the cylinder-piston-units are controlled by control signals generated in response to the measurements of said z-axis translational movement, x-axis rotational movement and y-axis rotational movement of the vessel. According to this method it is advantageous when a resilient constraining system generating reaction forces upon disturbance of said rest position counteracts disturbances of said rest position.

According to still another further aspect, the invention relates to a control system for performing the method according to the invention, which control system comprises an actuator system adapted for translating a carrier frame along a z-axis and rotating the carrier frame around an x-axis and an y-axis, wherein the x-axis, y-axis and z-axis define an imaginary set of orthogonal axes, the z-axis extending vertical; a sensor system for sensing z-axis translational movement, x-axis rotational movement and y-axis rotational movement of a vessel and generating sensor signals representing said sensed movements of the vessel; and wherein the control system is arranged for generating control signals for driving the actuator system in response to said sensor signals such that the position of the carrier frame is compensated for said sensed movements of the vessel.

BRIEF DESCRIPTION OF THE DRAWINGS

The present invention will be explained further with reference to the enclosed drawings, in which.

DETAILED DESCRIPTION OF THE INVENTION

Figure 1:
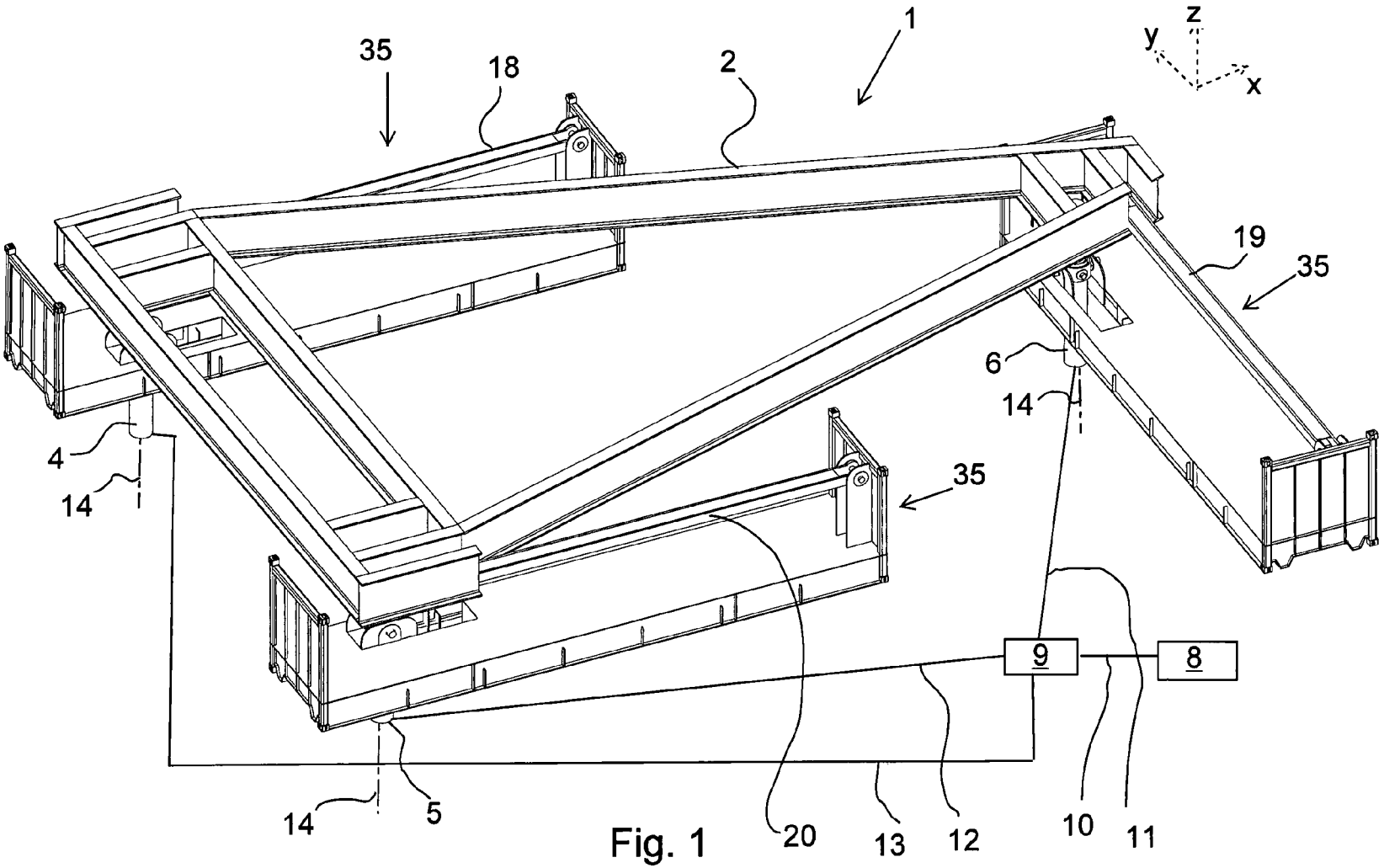
FIG. 1 is a perspective view of a first embodiment of a device according to the invention.
Figure 2:
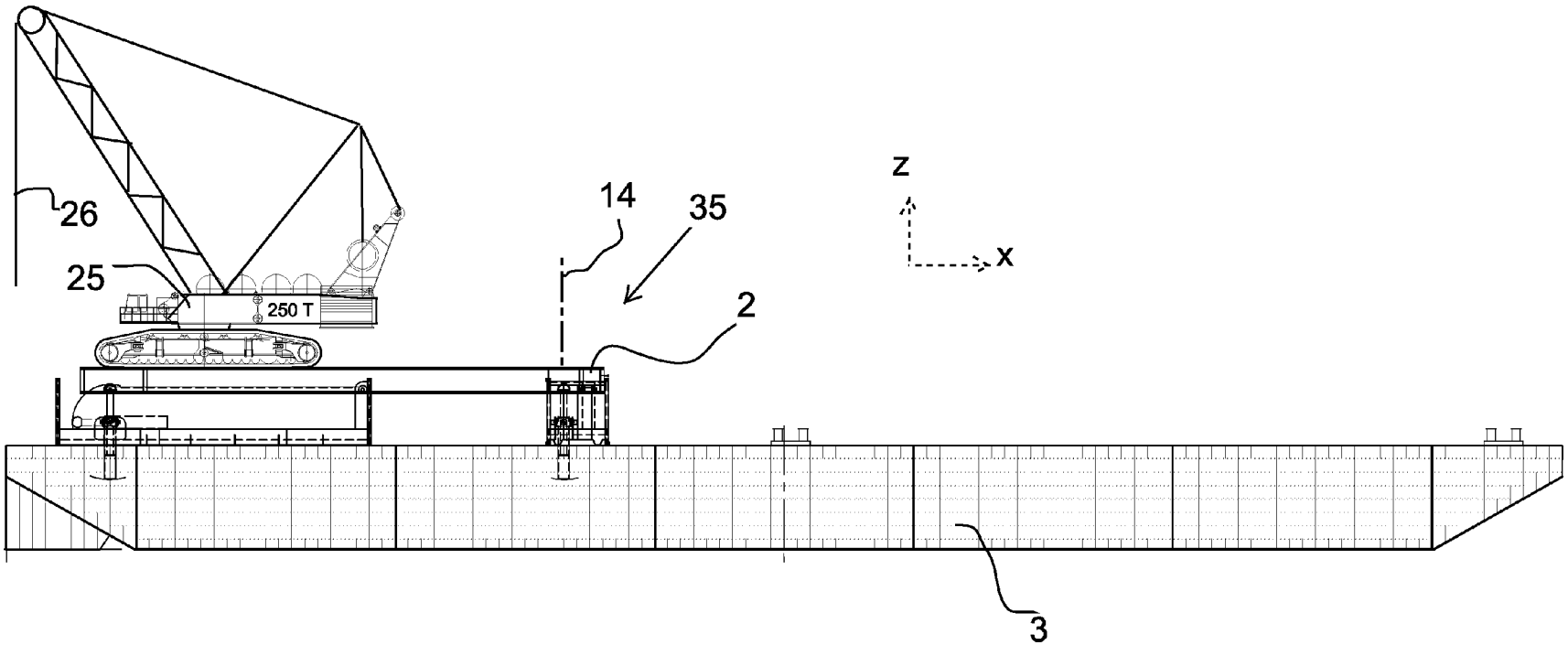
FIG. 2 is a side view of the device of FIG. 1, arranged on a vessel and carrying a crane.
Figure 3:
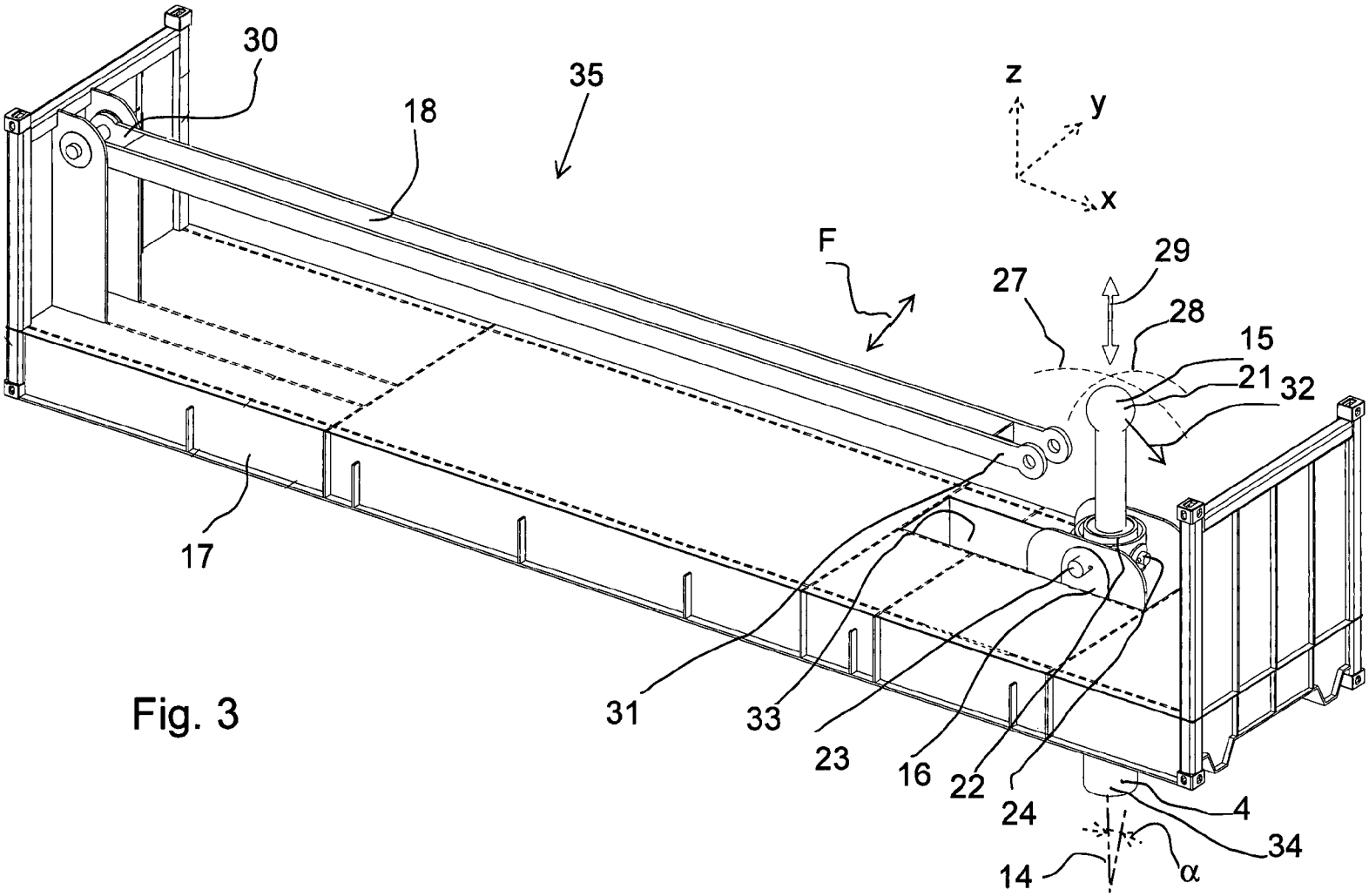
FIG. 3 is a perspective view of a base unit of the device of FIG. 1.

FIGS. 1-3 shows a device 1 according to a first embodiment of the invention. The device comprises a carrier frame 2, which is in this case triangular but might have any shape. The device 1 further comprises three hydraulic cylinder-piston-units 4, 5, 6—four, five or more cylinder-piston units is however also conceivable—, which together form the actuator system. In order to control the cylinder-piston-units a control system 9 is provided, which is connected by means of control lines 11, 12, 13 to each cylinder-piston-unit. This control system 9 generates control signals driving the actuator system in response to sensor signals 10 which come from a sensor system 8. The sensor system 8 is arranged for sensing z-axis translational movement, x-axis rotational movement and y-axis rotational movement of a vessel.

As shown in FIG. 2, the device 1 is provided on a vessel 3 and carries a crane 25 with hoisting cable 26. Instead of carrying a crane or gantry, the carrier frame might also be a landing platform for a helicopter or might be used for carrying another load.

Referring to FIG. 3, each cylinder-piston-unit 4, 5, 6 has an upper support 15 carrying the carrier frame and a lower support 16 supported on a base 17. The upper support 15 is in the form of a ball hinge 21 which supports a downwardly facing bearing surface on the carrier frame 2. The lower support 16 is a cardan joint 22 having two orthogonal hinge axes 23 and 24. The cardan joint 22 allows the cylinder-piston-unit to rotate around hinge 24 (x-axis) and hinge 23 (y-axis) relative to the base 17. The ball hinge 21 allows the cylinder-piston-unit to rotate relative to the carrier frame 2 around the x-axis, indicated by arrow 28, and the y-axis, indicated by arrow 27.

As indicated with arrow 29, the cylinder-piston-units 4, 5, 6 can move along their longitudinal axis 14. When one cylinder-piston-unit is extended or shortened more than one or both others, the ball hinges 21 and cardan joints 16 allow the cylinder-piston-units 4, 5, 6 to be slanted slightly with respect to the z-axis. The angle $\alpha$ between the longitudinal axis 14 and z-axis can vary in a range of [0°, 10°], but a range of [0°, 5°] is in general sufficient.

In order to prevent the carrier frame from drifting away due to the freedom of rotational movements of the cylinder-piston-units 4, 5, 6, there is provided a constraining system which restricts x-axis translational movement, y-axis translational movement and z-axis rotational movement of the carrier frame 2 with respect to the base to movements necessary to allow for z-axis translational movement, x-axis rotational movement and y-axis rotational movement of the carrier frame 2 with respect to the base 17 by said actuator system. In the embodiment of FIGS. 1-3, the constraining system comprises three bars 18, 19 and 20 of preferably steel. Each bar 18, 19, 20 is hinged at one end 30 to the base and at the other end 31 to the carrier frame 2. In longitudinal direction these bars function as essentially rigid push-pull elements. When a bar 18, 19, 20 is subjected to a transverse bending load in x- and/or y-direction, it will generate due to the resilient properties of the bar a (resilient) reaction force in the direction of double arrow F. The combination of reaction forces of all three bars 18, 19 and 20 counteracts any disturbance of the cylinder-piston-units from their rest position, which is the position in which the carrier frame and base are mutually parallel, which in this embodiment corresponds to the longitudinal axes 14 of all three cylinder-piston-units being mutually parallel. It is however noted, that—although not preferred—the cylinder-piston-units might in a rest position extend at an angle of say 5 to 10 degrees with respect to the z-axis (=vertical). According to the invention this is still to be understood as the cylinder-piston-units extending vertical.

As can be seen in FIG. 3, the base segments 35 have the dimensions of a sea container, in this case a 40 feet one. In order to transport a base segment easily and in compact manner, the cylinder-piston-units 4, 5, 6 can be swiveled 90° around axle 23 as indicated by arrow 32. The lower side 4 of the cylinder-piston-unit can pass through aperture 33 in order to come in a horizontal position inside the 'sea-container' base segment 35.

Figure 4:
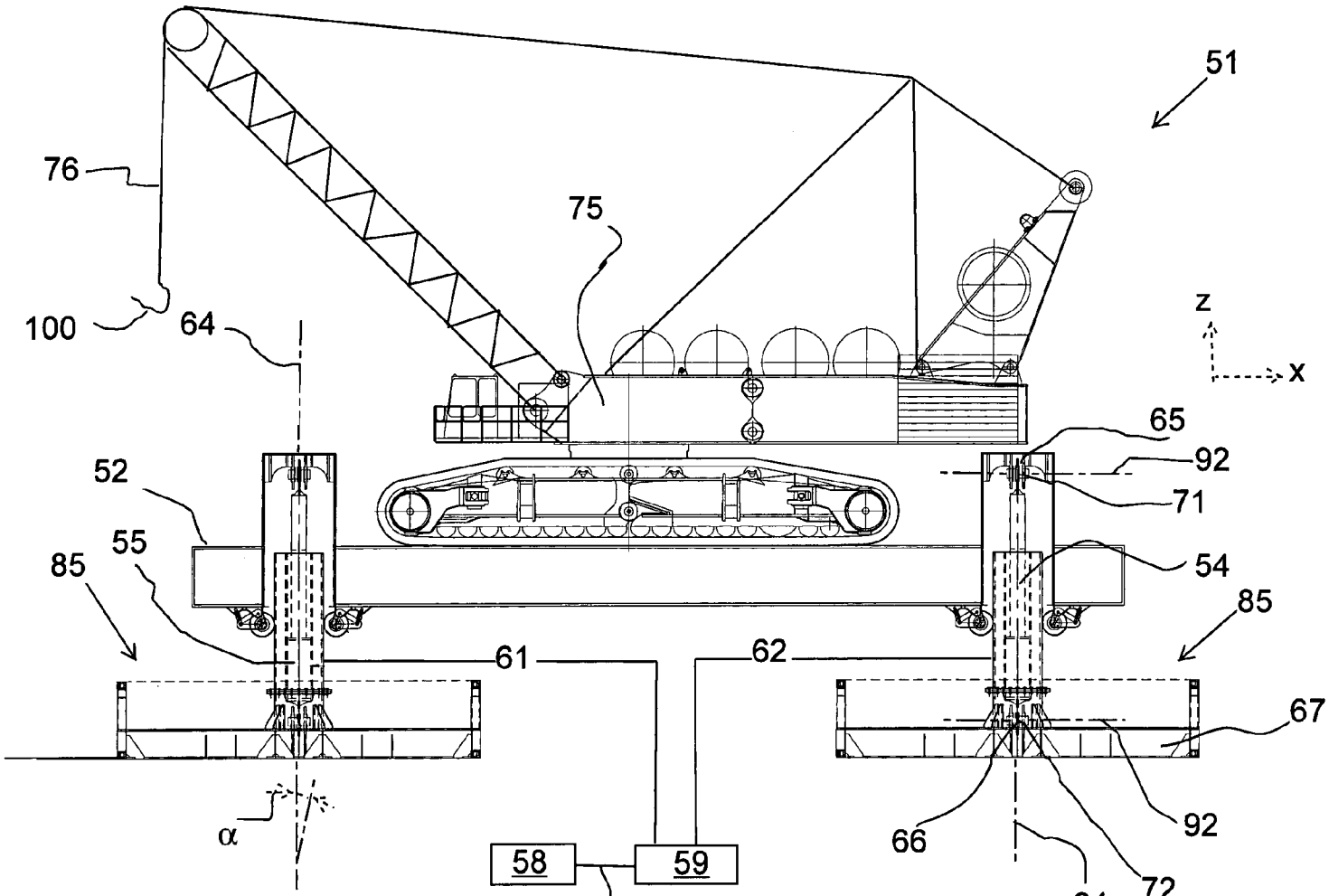
FIG. 4 is a side view of a second embodiment of a device according to the invention.
Figure 5:
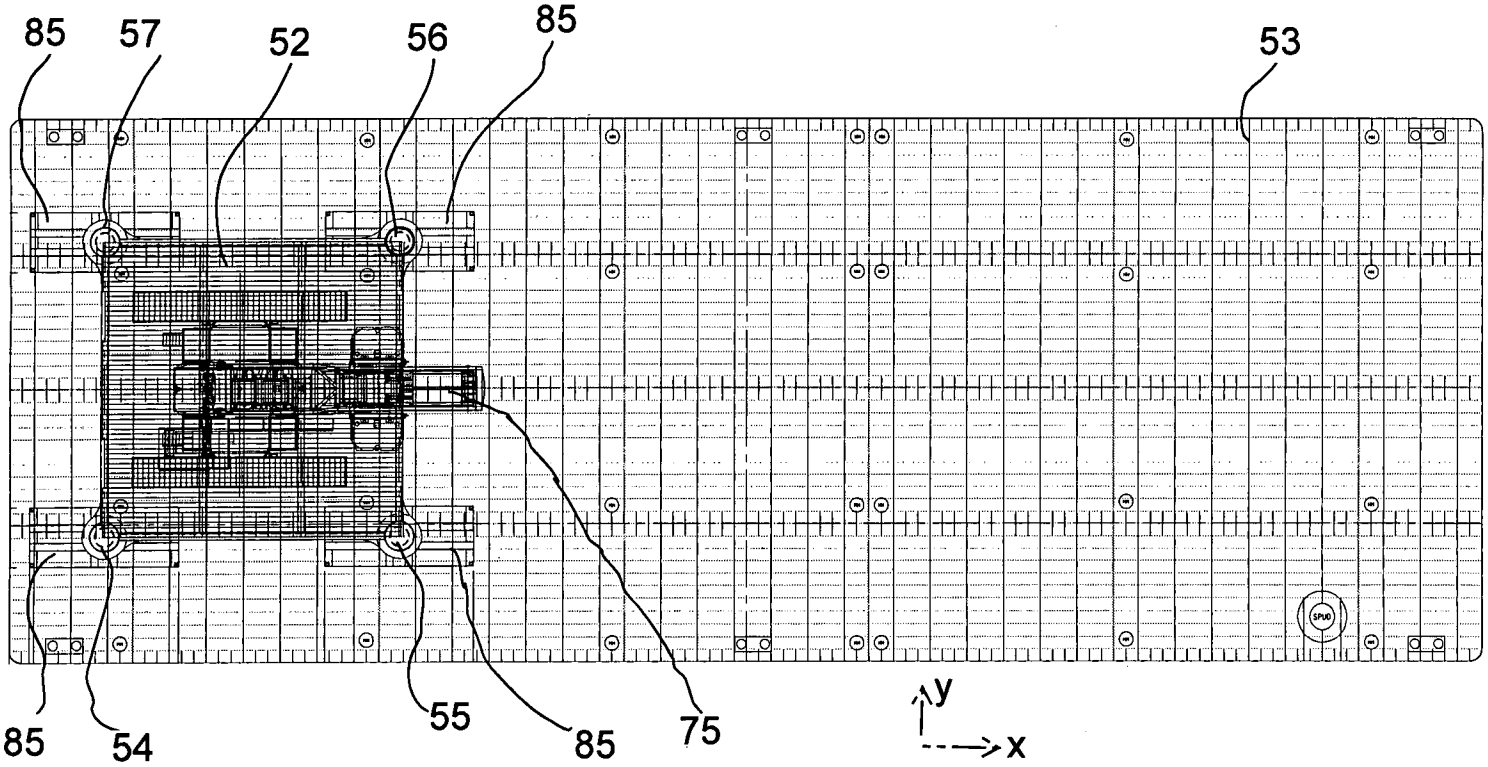
FIG. 5 is a top view on the device of FIG. 4, arranged on a vessel and carrying a crane.
Figure 6:
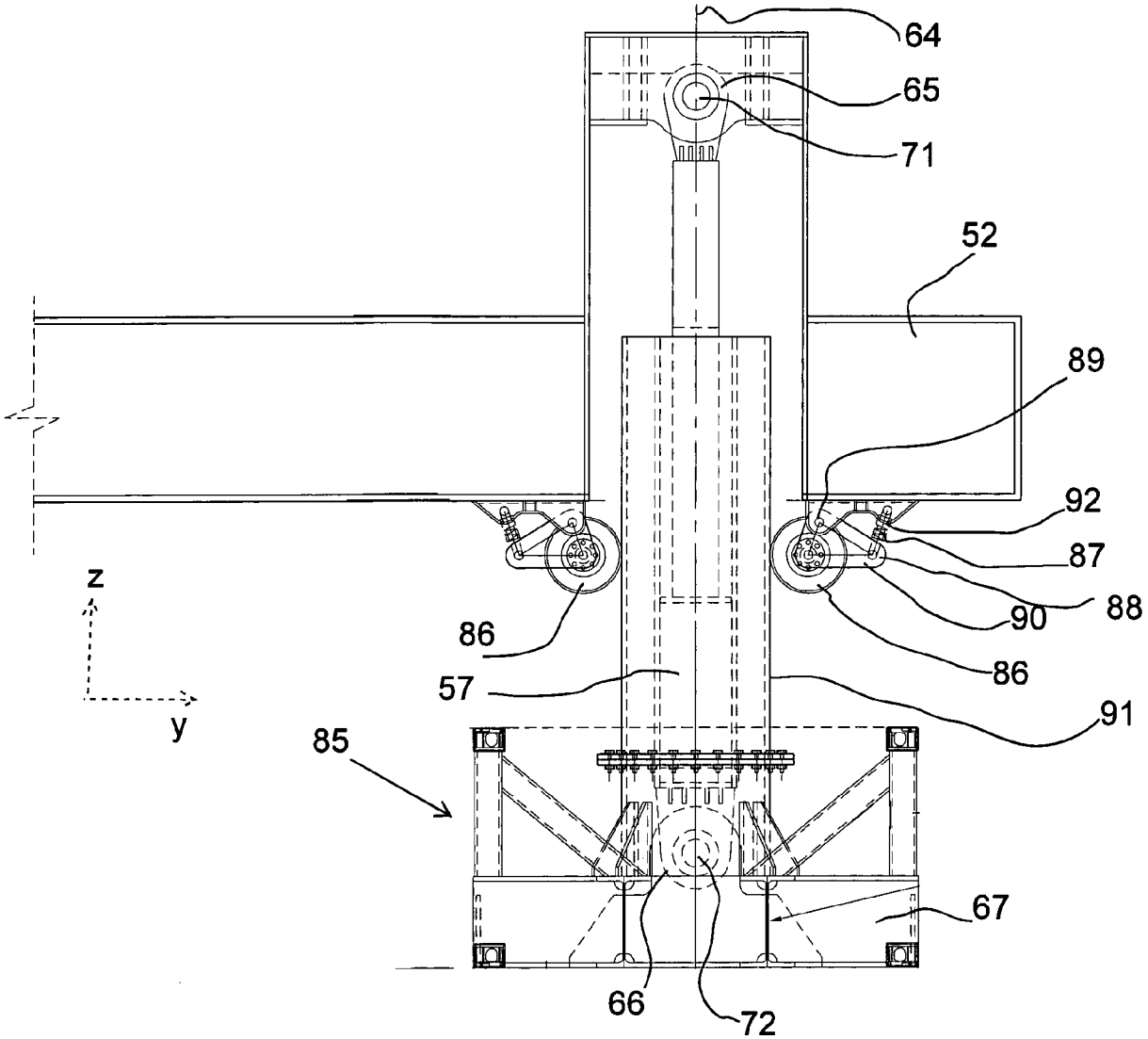
FIG. 6 is a detail of an actuator unit of the device according to FIGS. 4 and 5.

FIGS. 4-6 show a second embodiment of the device 51 according to the invention. The reference numbers used in FIGS. 4-6 correspond to the ones used in FIGS. 1-3 but increased with 50. The differences between the two embodiments are essentially the suspension of the cylinder-piston-units and the constraining system. Also the number of cylinder-piston units is different, but in this respect it is to be noted that the second embodiment can also be with three or more than four cylinder-piston-units and that the first embodiment can equally well be with four or more cylinder-piston-units. Also with respect to the embodiment of FIGS. 4-6, it is to be, that—although in a rest position mutually parallel cylinder-piston units are preferred—the cylinder-piston-units might in a rest position extend at an angle of say 5 to 10 degrees with respect to the z-axis (=vertical). According to the invention this is still to be understood as the cylinder-piston-units extending vertical.

In FIGS. 4-6, no. 51 indicates the device of the invention in general; no. 52 the carrier frame; no 53 indicates the vessel; no's. 54, 55, 56, 57 indicate cylinder-piston units, no 58 indicates the sensor system; no 59 indicates the control system; no 60 indicates a signal line for transfer of sensor signals to the control unit; no's 61 and 62 indicate control lines for transfer of control actions from the control system to the cylinder-piston-units; no 64 indicates the longitudinal axis of each cylinder-piston-unit; no 65 indicates the upper support of each cylinder-piston-unit; no 66 indicates the lower support of each cylinder-piston-unit; no 67 indicates the base; no 75 indicates a crane; no 76 indicates a hoisting cable; and no 85 indicates a base segment. The crane 75 can comprise a hoisting cable 76 or a gripper 100 which is hinged to a crane arm.

In the embodiment of FIGS. 4-6, the upper support 65 and lower support 66 of each cylinder-piston-unit are suspended by means of a spherical bearing 71, 72 to the carrier frame 52 and base 67, respectively. The main rotational axis 92—FIG. 4—of these spherical bearing extends in this embodiment essentially transverse to the longitudinal axis 64 of the cylinder-piston unit. It should however be noted that the main rotational axis of such a spherical bearing can very well extend in the same direction of said longitudinal axis 64, in which case said main rotational axis will preferably coincide with said longitudinal axis of the cylinder-piston-unit.

The cylinder-piston-units 54, 55, 56, 57 can move along their longitudinal axes 64. When one cylinder-piston-unit is extended or shortened more than one or more of the others, the spherical bearings 71 and 72 allow the cylinder-piston-units 4, 5, 6 to be slanted slightly with respect to the z-axis. The angle $\alpha$ between the longitudinal axis 64 and z-axis can easily vary in a range of [0°, 10°], but a range of [0°, 5°] is in general sufficient.

In order to prevent the carrier frame 52 from drifting away due to the freedom of rotational movements of the cylinder-piston-units 54, 55, 56, 57, there is provided a constraining system, which is in this embodiment a resilient system comprising at least one—in this embodiment four—column 91 fixed to the base 67 and extending in the z-axis direction as well as for each column at least three guiding wheels 86.

The guiding wheels 86 are arranged spaced around the column with intervals of 120° in case of three wheels 86 and intervals of 90° in case of four wheels. Each wheel 86 is carried by a triangular member which swivels around pivot 89 with respect to the carrier frame 52. A spring 87 pretensions each wheel 86 against the column 91. Inside each spring 87 a damper (92) might be provided. In case a cylinder-piston-units assumes a slightly slanting position ($\alpha \neq 0°$), one or more of the springs 87 are compressed and will develop in reaction a resilient reaction force counteracting the offset from the rest position ($\alpha = 0°$). When a cylinder-piston unit is extended or shortened, the wheels 86 will ride along the column 91. In this second embodiment there is provided a column around each cylinder-piston-unit.

The invention claimed is:

1. An assembly comprising:

a vessel which is adapted to be anchored for preventing the vessel from x-axis translational movement, y-axis translational movement and z-axis rotational movement; and/or provided with a dynamic positioning system arranged for preventing the vessel from x-axis translational movement, y-axis translational movement and z-axis rotational movement; and a motion compensation device for compensating a carrier frame on the vessel for water motion, wherein the device comprises:

a said carrier frame;

an actuator system adapted for translating the carrier frame along a z-axis and rotating the carrier frame around an x-axis and an y-axis, wherein the x-axis, y-axis and z-axis define an imaginary set of orthogonal axes, the z-axis extending vertical;

a sensor system for sensing z-axis translational movement, x-axis rotational movement and y-axis rotational movement of the vessel and generating sensor signals representing said sensed movements of the vessel; and a control system constructed to generate control signals to drive the actuator system in response to said sensor signals such that the position of the carrier frame is compensated for said sensed movements of the vessel whilst the vessel is anchored and/or kept in position by the dynamic positioning system to prevent the vessel from x-axis translational movement, y-axis translational movement and z-axis rotational movement;

wherein the actuator system comprises at least three cylinder-piston-units each having a vertical longitudinal axis;

wherein each cylinder-piston unit has an upper support for supporting the carrier frame on said cylinder-piston-unit and a lower support for supporting said cylinder-piston-unit on a base;

wherein said upper support of each cylinder-piston unit allows for rotational movement of the respective cylinder-piston-unit relative to the carrier frame around the x-axis as well as the y-axis; and/or said lower support of each cylinder-piston unit allows for rotational movement of the respective cylinder-piston-unit relative to the base around the x-axis as well as the y-axis;

wherein the device further comprises a mechanical constraining system restricting x-axis translational movement, y-axis translational movement and z-axis rotational movement of the carrier frame with respect to the base; and wherein the constraining system comprises at least three bars, each bar being hinged with one end to the base and with the other end to the carrier frame.

2. The assembly according to claim 1, wherein said bars extend horizontally, and wherein at least two said bars are arranged orthogonally with respect to each other.

3. The assembly according to claim 1, wherein said bars function in their longitudinal direction as essentially rigid push-pull-elements.

4. The assembly according to claim 1, wherein each end of said bars is hingedly attached to the carrier frame and base, respectively, by means of a cardan joint.

5. The assembly according to claim 1, wherein, on the one hand, the attachment of the ends of said bars is constrained against Z-axis rotation, and, on the other hand, the ends of a said bar are moveable with respect to each other by deflection.

6. The assembly according to claim 1, wherein said bars are made of steel.

7. The assembly according to claim 1, wherein the constraining system is a resilient constraining system, which upon disturbance of a rest position—defined as a position in which the carrier frame and base frame are parallel to each other—generates resilient reaction forces counteracting the disturbance.

8. The assembly according to claim 6, wherein the constraining system is damped.

9. The assembly according to claim 1, wherein said upper support of each cylinder-piston unit comprises one of the group of: cardan joint, spherical bearing or ball hinge.

10. The assembly according to claim 1, wherein said lower support of each cylinder-piston unit comprises one of the group of: cardan joint, spherical bearing or ball hinge.

11. The assembly according to claim 1, wherein said lower support of each cylinder-piston unit and said upper support of each cylinder-piston unit each comprise one of the group of: cardan joint, spherical bearing or ball hinge.

12. The assembly according to claim 1, wherein the base comprises a separate base segment for each cylinder-piston-unit, and wherein each separate base segment has outer dimensions corresponding to the outer dimensions of a sea container having a length of 20, 30 or 40 feet.

13. The assembly according to claim 1, wherein each cylinder-piston-unit is hingedly mounted to either the carrier frame or the base for storing the cylinder-piston-unit with its longitudinal direction extending transverse.

14. The assembly according to claim 1, wherein each cylinder-piston-unit has a maximum stroke in the range of 1 to 3.5 meter.

15. The assembly according to claim 14, wherein the maximum stroke is in the range of 1 to 2 meter.

16. The assembly according to claim 1, wherein, viewed transverse to the z-axis, the largest distance between two said cylinder-piston-units of said at least three cylinder-piston units is at most 40 meters.

17. The assembly according to claim 16, wherein the largest distance is at most 30 meters.

18. The assembly according to claim 1, wherein the at least three cylinder-piston-units are hydraulic cylinder-piston-units.

19. The assembly according to claim 1 further comprising a crane.

20. The assembly according to claim 19, wherein the crane comprises a hoisting cable.

21. The assembly according to claim 20, wherein the crane comprises a gripper.

22. The assembly according to claim 1, wherein the carrier frame is a landing platform for a helicopter, which landing platform is provided with a landing marking.

23. The assembly according to claim 1, wherein the vessel is adapted to be anchored for preventing the vessel from x-axis translational movement, y-axis translational movement and z-axis rotational movement.

24. The assembly according to claim 1, wherein the vessel is provided with the dynamic positioning system arranged for preventing the vessel from x-axis translational movement, y-axis translational movement and z-axis rotational movement.

25. The assembly accordingly to claim 1 wherein the control system generates the control signals to drive the actuator system to maintain an angle of 0° to 5° between the vertical longitudinal axis of each of the at least three cylinder-piston units and the z-axis.

26. The assembly accordingly to claim 1 wherein the control system generates the control signals to drive the actuator system to maintain an angle of 0° to 10° between the vertical longitudinal axis of each of the at least three cylinder-piston units and the z-axis.

27. A method for compensating a carrier frame on a vessel for local water motion, comprising:

providing a vessel which is adapted to be anchored for preventing the vessel from x-axis translational movement, y-axis translational movement and z-axis rotational movement; and/or provided with a dynamic positioning system arranged for preventing the vessel from x-axis translational movement, y-axis translational movement and z-axis rotational movement;

supporting the carrier frame by an actuator system comprising at least three cylinder-piston-units, each having a vertical longitudinal axis;

measuring z-axis translational movement, x-axis rotational movement and y-axis rotational movement of the vessel;

controlling the cylinder-piston-units by control signals generated by a control system in response to the measurements of said z-axis translational movement, x-axis rotational movement and y-axis rotational movement of the vessel such that the position of the carrier frame is compensated for said measurements of said z-axis translational movement, x-axis rotational movement and y-axis rotational movement of the vessel whilst the vessel is anchored and/or kept in position by the dynamic positioning system to prevent the vessel from x-axis translational movement, y-axis translational movement and z-axis rotational movement; and restricting, with a constraining system, X-axis translational movement, Y-axis translational movement and Z-axis rotational movement of the carrier frame with respect to the vessel to movements necessary to allow for Z-axis rotational movement, X-axis rotational movement and Y-axis rotational movement of the carrier frame with respect to the vessel by said actuator system;

wherein the constraining system comprises at least three bars, each bar being hinged to the base with one end and to the carrier frame with the other end.

28. An assembly comprising:

a vessel which is adapted to be anchored for preventing the vessel from x-axis translational movement, y-axis translational movement and z-axis rotational movement; and/or provided with a dynamic positioning system arranged for preventing the vessel from x-axis translational movement, y-axis translational movement and z-axis rotational movement; and a motion compensation device for compensating a carrier frame on a vessel for water motion, wherein the device comprises:

a said carrier frame;

an actuator system adapted for translating the carrier frame along a z-axis and rotating the carrier frame around an x-axis and an y-axis, wherein the x-axis, y-axis and z-axis define an imaginary set of orthogonal axes, the z-axis extending vertical;

a sensor system for sensing z-axis translational movement, x-axis rotational movement and y-axis rotational movement of the vessel and generating sensor signals representing said sensed movements of the vessel; and a control system constructed to generate control signals to drive the actuator system in response to said sensor signals such that the position of the carrier frame is compensated for said sensed movements of the vessel whilst the vessel is anchored and/or kept in position by the dynamic positioning system to prevent the vessel from x-axis translational movement, y-axis translational movement and z-axis rotational movement;

wherein the actuator system comprises at least three cylinder-piston-units each having a vertical longitudinal axis;

wherein each cylinder-piston unit has an upper support for supporting the carrier frame on said cylinder-piston-unit and a lower support for supporting said cylinder-piston-unit on a base;

wherein said upper support of each cylinder-piston unit allows for rotational movement of the respective cylinder-piston-unit relative to the carrier frame around the x-axis as well as the y-axis; and/or said lower support of each cylinder-piston unit allows for rotational movement of the respective cylinder-piston-unit relative to the base around the x-axis as well as the y-axis;

wherein the device further comprises a mechanical constraining system restricting x-axis translational movement, y-axis translational movement and z-axis rotational movement of the carrier frame with respect to the base;

wherein the constraining system comprises at least three bars, each bar being hinged with one end to the base and with the other end to the carrier frame;

wherein each cylinder-piston-unit has a maximum stroke in the range of 1 to 3.5 meter; and wherein the constraining system is a resilient constraining system generating resilient reaction forces upon disturbance of a rest position, which reaction forces counteract disturbances of said rest position, wherein the rest position is defined as a position in which the carrier frame and base frame are parallel to each other.

29. A method for compensating a carrier frame on a vessel for local water motion, comprising:

providing a vessel which is adapted to be anchored for preventing the vessel from x-axis translational movement, y-axis translational movement and z-axis rotational movement; and/or provided with a dynamic positioning system arranged for preventing the vessel from x-axis translational movement, y-axis translational movement and z-axis rotational movement;

supporting the carrier frame by an actuator system comprising at least three cylinder-piston-units, each having a vertical longitudinal axis;

measuring z-axis translational movement, x-axis rotational movement and y-axis rotational movement of the vessel;

controlling the cylinder-piston-units by control signals generated by a control system in response to the measurements of said z-axis translational movement, x-axis rotational movement and y-axis rotational movement of the vessel such that the position of the carrier frame is compensated for said measurements of said z-axis translational movement, x-axis rotational movement and y-axis rotational movement of the vessel whilst the vessel is anchored and/or kept in position by the dynamic positioning system to prevent the vessel from x-axis translational movement, y-axis translational movement and z-axis rotational movement; and restricting, with a constraining system, X-axis translational movement, Y-axis translational movement and Z-axis rotational movement of the carrier frame with respect to the vessel to movements necessary to allow for Z-axis rotational movement, X-axis rotational movement and Y-axis rotational movement of the carrier frame with respect to the vessel by said actuator system;

wherein the constraining system comprises at least three bars, each bar being hinged to the base with one end and to the carrier frame with the other end;

wherein each cylinder-piston-unit has a maximum stroke in the range of 1 to 3.5 meter; and wherein said bars extend horizontally, and wherein at least two said bars are arranged orthogonally with respect to each other.

30. An assembly comprising:

a vessel which is adapted to be anchored for preventing the vessel from x-axis translational movement, y-axis translational movement and z-axis rotational movement; and/or provided with a dynamic positioning system arranged for preventing the vessel from x-axis translational movement, y-axis translational movement and z-axis rotational movement; and a motion compensation device for compensating a carrier frame on the vessel for water motion and a crane, wherein the device comprises:

a said carrier frame;

an actuator system adapted for translating the carrier frame along a z-axis and rotating the carrier frame around an x-axis and an y-axis, wherein the x-axis, y-axis and z-axis define an imaginary set of orthogonal axes, the z-axis extending vertical;

a sensor system for sensing z-axis translational movement, x-axis rotational movement and y-axis rotational movement of the vessel and generating sensor signals representing said sensed movements of the vessel; and a control system constructed to generate control signals to drive the actuator system in response to said sensor signals such that the position of the carrier frame is compensated for said sensed movements of the vessel whilst the vessel is anchored and/or kept in position by the dynamic positioning system to prevent the vessel from x-axis translational movement, y-axis translational movement and z-axis rotational movement;

wherein the actuator system comprises at least three cylinder-piston-units each having a vertical longitudinal axis;

wherein each cylinder-piston unit has an upper support for supporting the carrier frame on said cylinder-piston-unit and a lower support for supporting said cylinder-piston-unit on a base;

wherein said upper support of each cylinder-piston unit allows for rotational movement of the respective cylinder-piston-unit relative to the carrier frame around the x-axis as well as the y-axis; and/or said lower support of each cylinder-piston unit allows for rotational movement of the respective cylinder-piston-unit relative to the base around the x-axis as well as the y-axis;

wherein the device further comprises a mechanical constraining system restricting x-axis translational movement, y-axis translational movement and z-axis rotational movement of the carrier frame with respect to the base; and wherein the constraining system comprises at least three bars, each bar being hinged with one end to the base and with the other end to the carrier frame; and wherein said bars function in their longitudinal direction as essentially rigid push-pull-elements.

31. A method for compensating a carrier frame having a crane on a vessel for local water motion, comprising:

providing a vessel which is adapted to be anchored for preventing the vessel from x-axis translational movement, y-axis translational movement and z-axis rotational movement; and/or provided with a dynamic positioning system arranged for preventing the vessel from x-axis translational movement, y-axis translational movement and z-axis rotational movement;

supporting the carrier frame by an actuator system comprising at least three cylinder-piston-units, each having a vertical longitudinal axis;

measuring z-axis translational movement, x-axis rotational movement and y-axis rotational movement of the vessel;

controlling the cylinder-piston-units by control signals generated by a control system in response to the measurements of said z-axis translational movement, x-axis rotational movement and y-axis rotational movement of the vessel such that the position of the carrier frame is compensated for said measurements of said z-axis translational movement, x-axis rotational movement and y-axis rotational movement of the vessel whilst the vessel is anchored and/or kept in position by the dynamic positioning system to prevent the vessel from x-axis translational movement, y-axis translational movement and z-axis rotational movement; and restricting, with a constraining system, X-axis translational movement, Y-axis translational movement and Z-axis rotational movement of the carrier frame with respect to the vessel to movements necessary to allow for Z-axis rotational movement, X-axis rotational movement and Y-axis rotational movement of the carrier frame with respect to the vessel by said actuator system;

wherein the constraining system comprises at least three bars, each bar being hinged to the base with one end and to the carrier frame with the other end;

wherein the vessel includes a crane and wherein the carrier frame carries a crane.

32. The method according to claim 31, wherein the crane comprises a hoisting cable or a gripper.

33. The method accordingly to claim 27 wherein the control system generates the control signals to drive the actuator system to maintain an angle of 0° to 5° between the vertical longitudinal axis of each of the at least three cylinder-piston units and the z-axis.

34. The method accordingly to claim 27 wherein the control system generates the control signals to drive the actuator system to maintain an angle of 0° to 10° between the vertical longitudinal axis of each of the at least three cylinder-piston units and the z-axis.

* * * * *